US010744378B2

(12) United States Patent
Onuki et al.

(10) Patent No.: US 10,744,378 B2
(45) **Date of Patent: *Aug. 18, 2020**

(54) GOLF CLUB HEAD

(71) Applicant: Sumitomo Rubber Industries, Ltd., Kobe-shi, Hyogo (JP)

(72) Inventors: Masahide Onuki, Kobe (JP); Hiroshi Hasegawa, Kobe (JP); Hiromasa Tsunashima, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/287,739

(22) Filed: Feb. 27, 2019

(65) Prior Publication Data

US 2019/0262669 A1 Aug. 29, 2019

(30) Foreign Application Priority Data

Feb. 28, 2018 (JP) ..... 2018-035265

(51) Int. Cl.
*A63B 53/04* (2015.01)
*A63B 71/06* (2006.01)

(52) U.S. Cl.
CPC .. *A63B 53/0466* (2013.01); *A63B 2053/0425* (2013.01); *A63B 2053/0433* (2013.01); *A63B 2053/0437* (2013.01); *A63B 2071/0694* (2013.01); *A63B 2209/00* (2013.01)

(58) Field of Classification Search
CPC .... A63B 2053/0437; A63B 2053/0433; A63B 2053/0425; A63B 53/0466; A63B 60/52; A63B 60/54
USPC ..... 473/324–350, 287–292
See application file for complete search history.

(56) References Cited

U.S. PATENT DOCUMENTS

| | | | | |
|---|---|---|---|---|
| 4,928,965 | A * | 5/1990 | Yamaguchi | A63B 53/04 473/332 |
| 6,440,008 | B2 * | 8/2002 | Murphy | A63B 53/04 473/324 |
| 7,121,957 | B2 * | 10/2006 | Hocknell | A63B 53/02 473/342 |
| 7,413,520 | B1 * | 8/2008 | Hocknell | A63B 53/0466 473/345 |
| 8,007,369 | B2 * | 8/2011 | Soracco | A63B 53/0466 473/332 |
| 8,435,134 | B2 * | 5/2013 | Tang | A63B 53/04 473/329 |
| 9,216,324 | B2 * | 12/2015 | Shear | A63B 53/0466 |
| 10,537,769 | B2 * | 1/2020 | Onuki | A63B 53/0466 |
| 2014/0106903 | A1 | 4/2014 | Nakamura | |

FOREIGN PATENT DOCUMENTS

JP 2014-79447 A 5/2014

* cited by examiner

*Primary Examiner* — Sebastiano Passaniti
(74) *Attorney, Agent, or Firm* — Birch, Stewart, Kolasch & Birch, LLP

(57) ABSTRACT

A hollow golf club head 1 comprises a face portion 2 which includes a club face 2*a* for striking a ball, and a main body 3 extending rearward of the head from the face portion 2. The face Portion 2 is made of a low-specific-gravity material having a specific gravity of 4.0 or less. The main body 3 is provided in its face portion 2 side with a low stiffness zone 10 where the stiffness is locally reduced.

20 Claims, 14 Drawing Sheets

GOLF CLUB HEAD

TECHNICAL FIELD

The present invention relates to a golf club head, more particularly to a golf club head having a hollow structure.

BACKGROUND ART

A hollow wood golf club head of which face portion is made of a low-specific-gravity material having a specific gravity of 4.0 or less such as an aluminum alloy or a magnesium alloy has been proposed (see, paragraph 0028 of the following Patent Document 1). This type of golf club head can allocate more mass to the back of the face portion in exchange for lightening the face portion. Therefore, this kind of golf club head provides a large moment of inertia, and the effect of stabilizing the direction of the hit ball is expected.

On the other hand, the tensile strength of such low-specific-gravity material is much smaller than that of high-specific-gravity materials (for example, titanium alloys etc.) having a specific gravity of more than 4.0.

For example, typical tensile strengths of the aluminum alloys and magnesium alloys are 470 MPa and 270 MPa, respectively, which are less than a half of the tensile strength of 960 MPa of a typical titanium alloy. Therefore, in order to manufacture a golf club head using the low-specific-gravity material for the face portion, it was necessary to configure the face portion with a considerably large thickness to satisfy the practical durability, Patent Document 1: Japanese Patent Application Publication No. 2014-79447

SUMMARY OF THE INVENTION

Problems to be Solved by the Invention

Incidentally, the bending rigidity of a face portion becomes larger depending on the cube of its thickness. On the other hand, the bending rigidity of a face portion greatly affects the coefficient of restitution of the golf club head against a ball, and as the stiffness of the face portion increases, the coefficient of restitution of the head tends to decrease.

For the above reasons, a conventional golf club head using a low-specific-gravity material for the face portion has low rebound performance, and it was not enough to increase the flight distance of the hit ball.

The present invention has been devised in view of the above problems, and a main object of the present invention is to provide a golf club head having a high moment of inertia and high rebound performance.

According to the present invention, a hollow golf club head comprises: a face portion having a club face for striking a ball, and a main body extending rearward of the head from the face portion, wherein the face portion is made of a low-specific-gravity material having a specific gravity of 4.0 or less, and the main body is provided in its face portion side with a low stiffness zone where the stiffness is locally reduced.

In such golf club head, since the face portion is made of the low-specific-gravity material having the specific gravity of 4.0 or less, it is possible that the face portion side of the golf club head is reduced in weight, and in exchange therefor, more mass can be allocated to the main body side. Therefore, the golf club head according to the present invention can provide a large moment of inertia, and in particular, can increase the moment of inertia around a vertical axis passing through the center of gravity of the head.

Further, the golf club head according to the present invention is provided in the face portion side of the main body with the low stiffness zone where the stiffness is locally reduced.

Generally, a low-specific-gravity material has lower strength than a high-specific-gravity material such as titanium alloy, therefore, the thickness of the face portion made of the low-specific-gravity material tends to be larger than the thickness of the face portion made of the high-specific-gravity material. However, by providing the low stiffness zone in the main body, it is possible to locally largely deflect the low stiffness zone when striking a ball with the club face, therefore, the golf club head according to the present invention can exhibit a high coefficient of restitution (namely, high rebound performance) even if the face portion is made highly rigid.

Such low stiffness zone may comprise void portions penetrating the main body from the inside to the outside of the head, and connecting portions extending in the front-rear direction of the head. In this case, it is preferable that the void portions and the connecting portions are alternately arranged along the peripheral edge of the club face.

The connecting portions may include inclined connecting portions comprising inclined elements inclined with respect to the front-rear direction of the head.

The inclined connecting portions may include, as the inclined elements, a first inclined element, and a second inclined element inclined in a direction opposite to the first inclined element.

The low stiffness zone may be disposed in a crown portion, a side portion or a sole portion of the main body.

The face portion may be made of an aluminum alloy, a magnesium alloy, an aluminum lithium alloy, a magnesium lithium alloy or an FRP (fiber-reinforced plastic).

The face portion made of the low-specific-gravity material may have a minimum thickness of 3.0 mm or more.

The club face may have a coefficient of restitution of 0.800 or more at a sweet spot of the club face.

The golf club head may have a primary natural frequency of from 700 to 1500 Hz when measured under one end fixing condition where only the sweet spot of the club face is fixed.

The moment of inertia of the head around a vertical axis passing through the center of gravity of the head may be 4000 to 6000 gram sq·cm.

The moment of inertia of the head around a horizontal axis extending in a toe-heel direction of the head passing through the center of gravity of the head may be 2000 to 4000 gram sq·cm.

The golf club head may have a center-of-gravity distance of from 17 to 35 mm.

The face portion may have a mass of from 15 to 45 grams.

The specific gravity of the low-specific-gravity material may be 3.0 or less.

The main body may be made of a high-specific-gravity material having a specific gravity higher than 4.0.

According to the present invention, therefore, the golf club head can exhibit high rebound performance while having a large moment of inertia.

DESCRIPTION OF THE PREFERRED EMBODIMENTS

Figure 1:
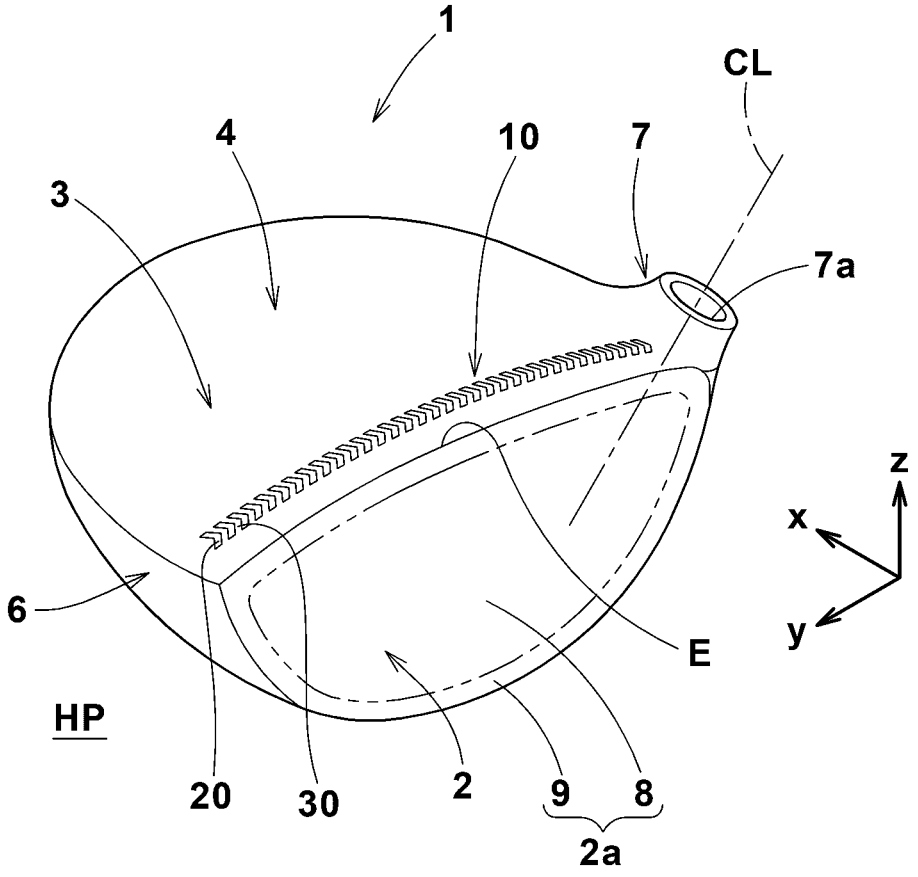
FIG. 1 is a perspective view of a golf club head according to the present embodiment.

Hereinafter, embodiments of the present invention will be described with reference to the accompanying drawings. The embodiments detailed below and specific configurations shown in the drawings are for understanding the contents of the present invention, therefore, the present invention is not limited to these specific configurations. Further, in the following description, it is to be noted that same or common components are denoted by the same reference numerals, and redundant explanations are omitted.

Figure 2:
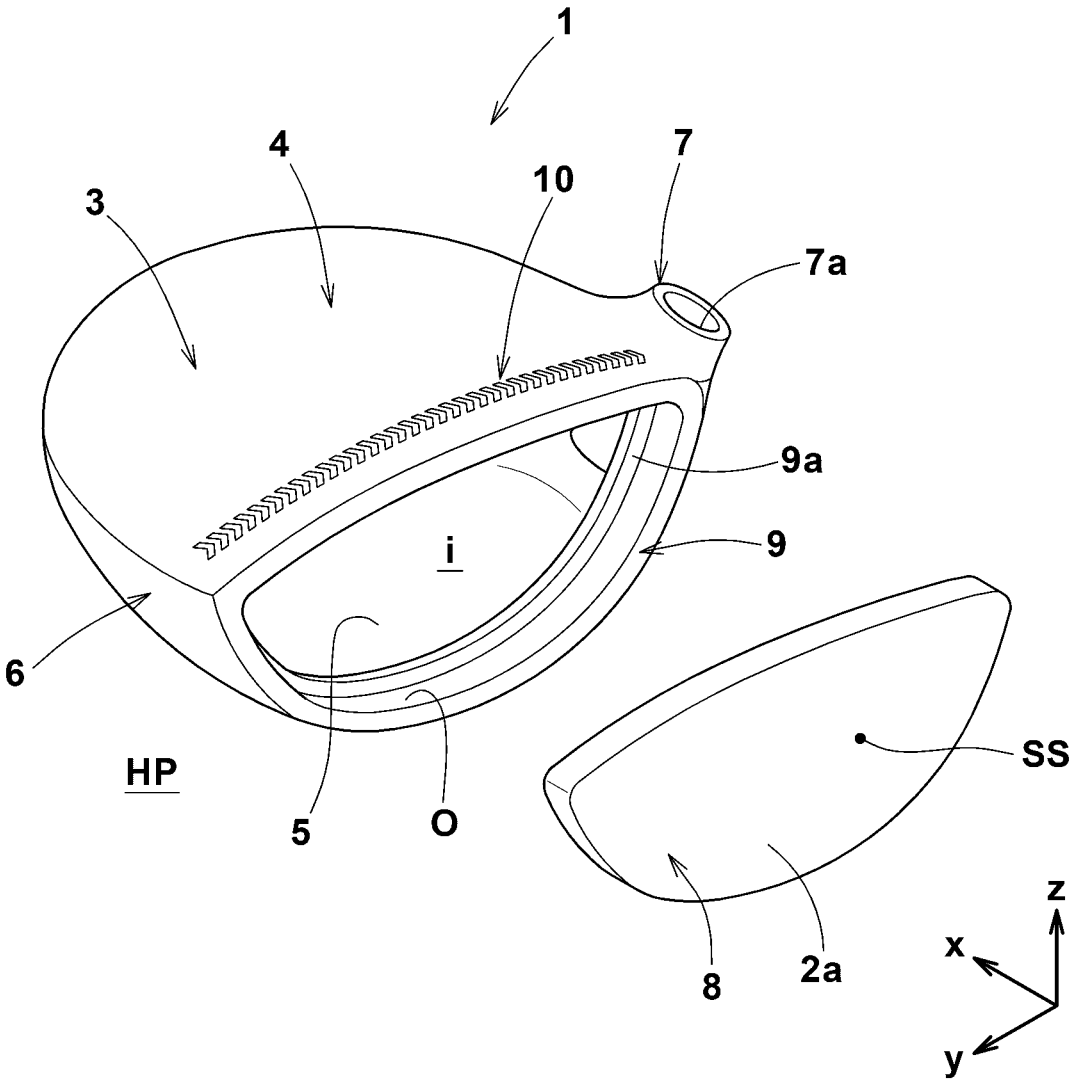
FIG. 2 is an exploded perspective view of the golf club head shown in FIG. 1.
Figure 3:
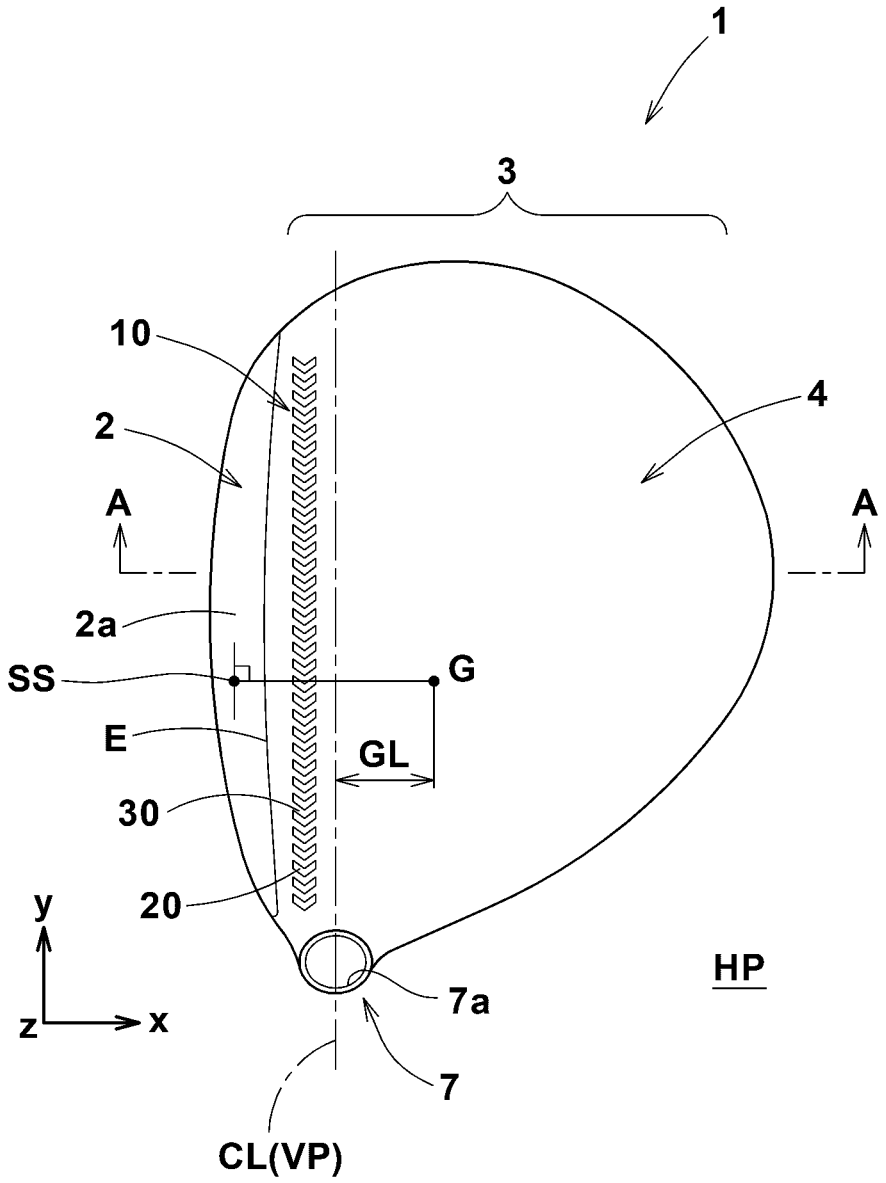
FIG. 3 is a plan view of the golf club head shown in FIG. 1.
Figure 4:
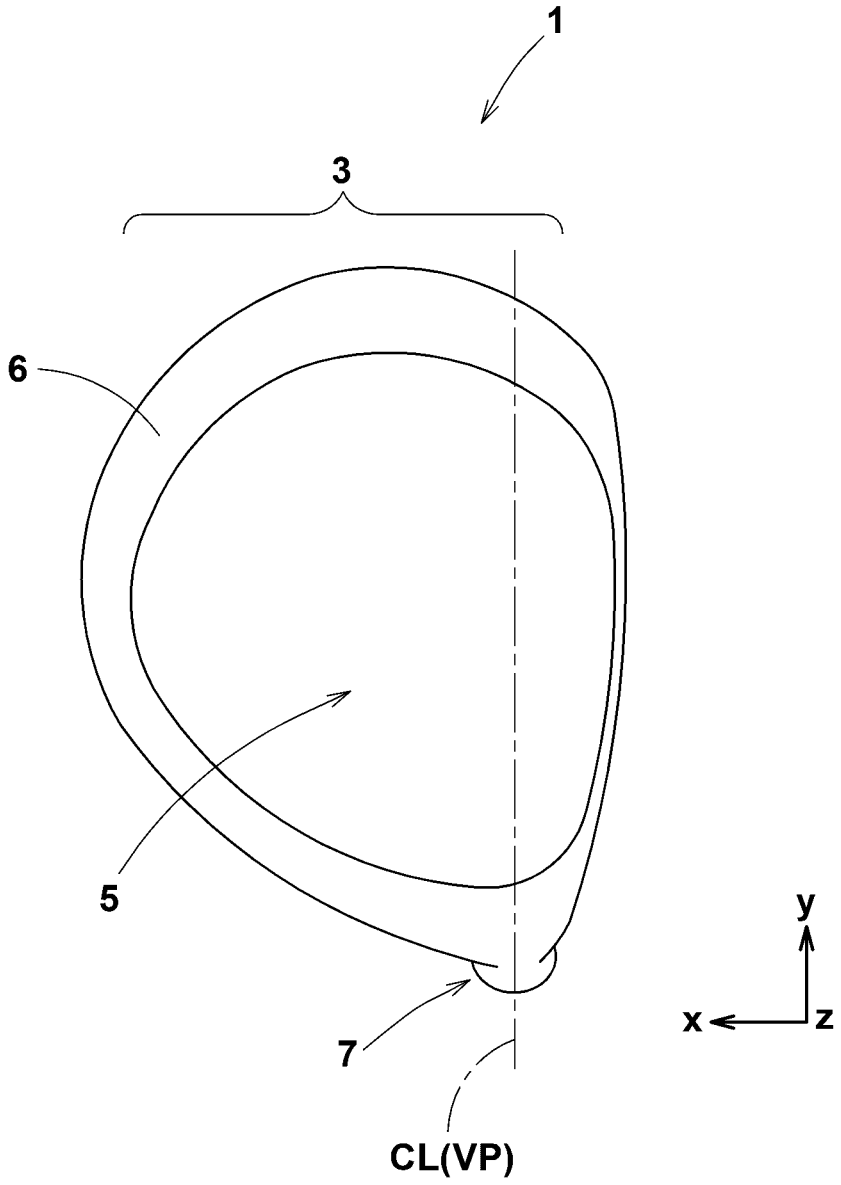
FIG. 4 is a bottom view of the golf club head shown in FIG. 1.
Figure 5:
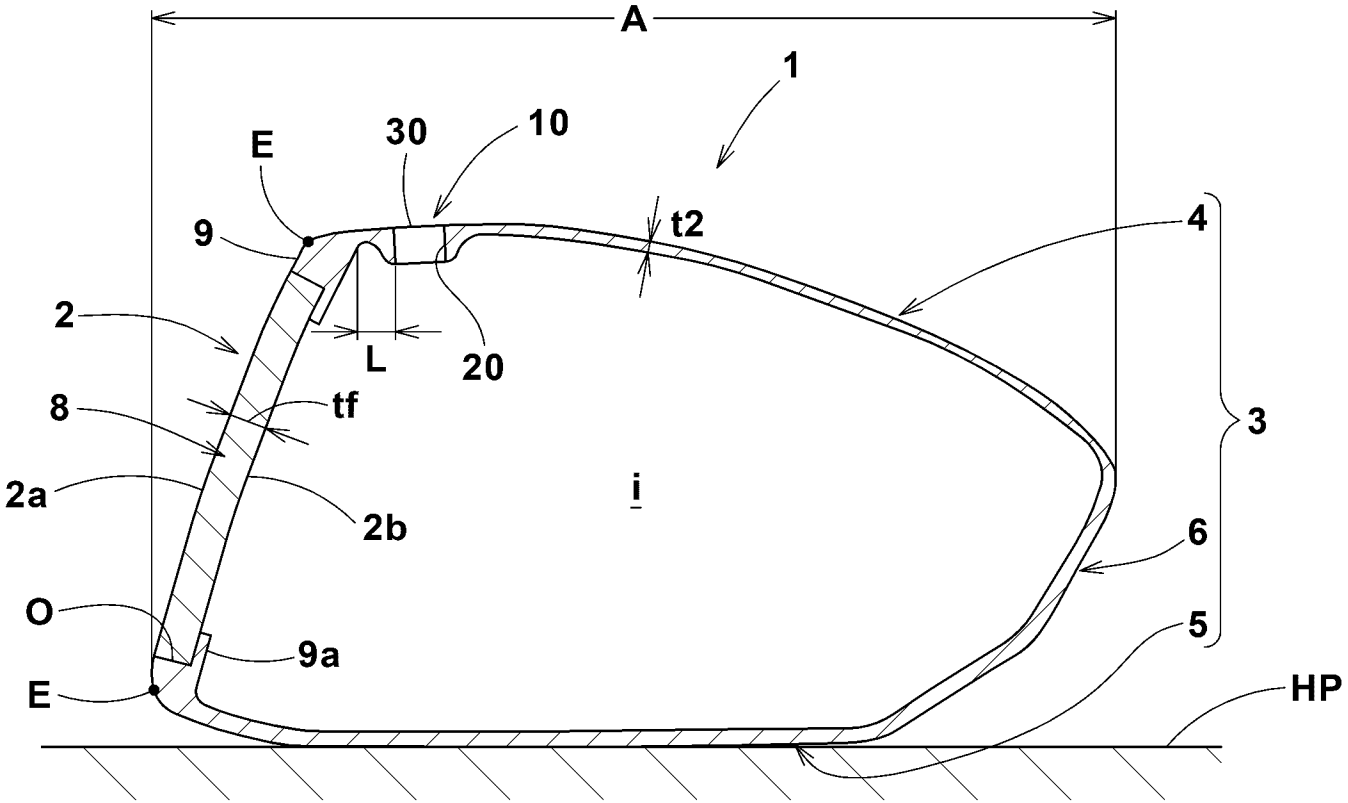
FIG. 5 is an enlarged cross-sectional view taken along line A-A in FIG. 3.

FIG. 1 is a perspective view of a golf club head 1 as an embodiment of the present invention (hereinafter may be simply referred to as the "head"). FIG. 2 is an exploded perspective view thereof. FIGS. 3 to 5 are a plan view and a bottom view of the head 1 shown in FIG. 1 and an enlarged cross-sectional view taken along line A-A in FIG. 3, respectively.

In FIGS. 1 to 5, the head 1 in its standard state is shown.

[Standard State of Head]

The standard state of the head 1 is a state in which the head 1 is kept at its loft angle and lie angle (not shown) with respect to a horizontal plane HP. In the standard state, a shaft center line CL of the head 1 is placed in an vertical plane VP. The horizontal direction y parallel to the vertical plane VP is the toe-heel direction of the head 1.

The horizontal direction x orthogonal to the vertical plane VP is the front-rear direction of the head.

The vertical direction z orthogonal to both the directions x and y is the up-down direction of the head.

Unless otherwise noted, various dimensions and directions relating to the head 1 are described as being in the standard state.

In FIGS. 1 to 5, the head 1 in the present embodiment is provided therein with a hollow portion i (shown in FIGS. 2 and 5), and has a typical shape of a wood type golf club head, for example. Preferably, the head 1 is configured as a driver head. The wood type golf club head includes heads for at least driver (#1), brushy (#2), spoon (#3), buffy (#4) and clique (#5). In addition, the wood type golf club head 1 includes heads having substantially similar shapes to those listed above even though their club numbers or names differ from those listed above.

As another embodiment, the head 1 may be configured, for example, as a head for a utility type or an iron type club.

The head 1 in the present embodiment comprises, for example, a face portion 2, and a main body 3 extending rearward from the face portion 2.

[Face Portion]

The face portion 2 is a portion for striking a ball, and its front surface constitutes a surface for striking a ball, that is, a club face 2*a*. The back face 2*b* (shown in FIG. 5) of the face portion 2 faces the hollow portion i.

The face portion 2 is made of a low-specific-gravity material having a specific gravity of 4.0 or less.

In the head 1 in the present embodiment, at least an area intended for striking a ball in the face portion 2 is made of the low-specific-gravity material.

Therefore, the central part of the club face 2*a* needs to be formed by the low-specific-gravity material. But, a peripheral part including the peripheral edge E of the club face 2*a*, etc. which is intrinsically not intended for striking a ball, is not necessary to be formed by the low-specific-gravity material.

The face portion 2 of the present embodiment is composed of a face plate 8, and a peripheral edge portion 9 for holding the face plate 8 as shown in FIGS. 1, 2 and 5.

The face plate 8 is made of the low-specific-gravity material. As the low-specific-gravity material, it is possible to use metal materials, for examples, aluminum alloys (typical specific gravity of about 2.8), magnesium alloys (typical specific gravity of about 1.8), aluminum lithium alloys (typical specific gravity of about 2.5), magnesium lithium alloys (typical specific gravity of about 1.5) and the like, as well as other composite materials such as FRP (fiber-reinforced plastic) (typical specific gravity of about 1.5).

Preferably, the face portion 2 is made of a low-specific-gravity material having a specific gravity of 3.0 or less as listed above.

Preferably, the face plate 8 has a contour shape such that the front surface of the face plate 8 includes the sweet spot SS of the club face 2*a* and has an area of 70% or more, more preferably 80% or more of the overall area of the club face 2*a*. Since a wider area of the face portion 2 is formed by the low-specific-gravity material in this way, further weight saving of the face portion 2 is possible.

The sweet spot SS means the intersection of the club face 2*a* and a normal line drawn to the club face 2*a* from the center of gravity G of the head as shown in FIG. 3.

The peripheral edge portion 9 forms, for example, only a peripheral portion of the face portion 2 which is not originally intended to directly contact with a ball. The peripheral edge portion 9 defines an inner peripheral surface O on which the face plate 8 is mounted. Preferably, the peripheral part 9 comprises a backup part 9*a* for supporting the back side of the face plate 8. It is desirable that the backup part 9*a* is provided annularly along the inner peripheral surface O.

The face plate 8 is fixed to the inner peripheral surface O of the peripheral edge portion 9, for example, by adhesion, screwing, caulking or the like.

Preferably, the peripheral portion 9 is formed integrally with the main body 3 to be hereinafter described.

[Main Body of Head]

The main body 3 includes, for example, a crown portion 4, a sole portion 5 and a side portion 6, and surrounds the hollow portion i.

The crown portion 4 is continuous from the face portion 2 and forms the upper surface of the head.

The sole portion 5 is continuous from the face portion 2 and forms the bottom face of the head.

The side portion 6 connects the crown portion 4 and the sole portion 5. The toe side and the heel side of the side portion 6 are respectively connected to the toe side and the heel side of the face portion 2.

The face portion 2, the crown portion 4, the sole portion 5 and the side portion 6 define the hollow portion i behind the face portion 2.

A hosel portion 7 may be provided, for example, in a heel side of the crown portion as shown in FIG. 1 and FIG. 2. The hosel portion 7 is formed in a cylindrical shape having a shaft insertion hole 7*a* into which a tip end of a club shaft (not shown) is attached. The center line of the shaft insertion hole 7*a* corresponds to the center line CL of the club shaft.

The main body 3 of the head 1 is made of, for example, a metal material. As the metal material, for example, a high-specific-gravity metal material having a specific gravity of more than 4.0 is preferably used. As the high-specific-gravity metal material, various materials such as titanium, titanium alloy, stainless steel and the like can be used.

As another embodiment, the main body 3 may be partially made of a non-metallic material such as resin, rubber, elastomer or fiber reinforced resin.

In the main body 3, a weight member made of a high-specific-gravity metal material or the like may be disposed.

As described above, in the head 1 in the present embodiment, since the face portion 2 is made of the low-specific-gravity material having the specific gravity of 4.0 or less, the face portion 2 side of the head 1 is reduced in weight. Thereby, a large margin is produced in the mass of the head which is one of constraint conditions for manufacturing the head 1. As a result, it becomes possible to use a high-specific-gravity metallic material and/or a larger weight member (not shown) in the main body 3 of the head 1, which allows to allocate more mass to the proper place on the main body 3 side. This helps to increase a moment of inertia of the head 1, in particular the moment of inertia around a vertical axis passing through the center of gravity of the head (hereinafter referred to simply as the "right-and-left moment of inertia").

Preferably, the right-and-left moment of inertia is set in a range from 4000 to 6000 gram sq·cm, more preferably 4500 to 6000 gram sq·cm, for example, in order to suppress the right-and-left minute rotation of the head 1 at the time of a miss shot and thereby to stabilize the directionality of the hit ball.

Further, it is preferable that the moment of inertia of the head 1 around a horizontal axis extending in the toe-heel direction passing through the center of gravity of the head (hereinafter referred to as the "up-and-down moment of inertia") is set in a range from 2000 to 4000 gram sq·cm, more preferably 2800 to 4000 gram sq·cm in order to stabilize the amount of back spin of the hit ball by suppressing the up-and-down minute rotation of the head 1 at the time of miss shot.

As a preferred aspect of the head, it is possible to increase the center-of-gravity distance of the head 1. For example, the center-of-gravity distance GL is preferably set in a range from 17 to 35 mm.

Here, the center-of-gravity distance GL is, as shown in FIG. 3, the distance in the front-rear direction of the head between the center of gravity G of the head and the vertical plane VP including the shaft center line CL.

Preferably, the minimum thickness tf of the face portion 2 made of the low-specific-gravity material (in this embodiment, the minimum thickness of the face plate 8) is set in a range of 3.0 mm or more, more preferably 4.0 mm or more. Thereby, sufficient practical durability of the face portion 2 can be ensured even with the low-specific-gravity material having low strength.

Preferably, the mass of the face portion 2 is set in a range from 15 to 45 grams in order to obtain a larger margin from the limited mass of the head 1.

Here, the mass of the face portion 2 means the total mass of the portion sandwiched between the club face 2*a* and the back face 2*b* which is virtually extended to the outer surface of the head.

[Low Stiffness Zone]

The main body 3 of the head 1 in the present embodiment is provided in a face portion 2 side with a low stiffness zone 10 where the rigidity is locally reduced.

In the embodiment shown in FIGS. 1 to 5, the low stiffness zone 10 is formed in the crown portion 4. But, the low stiffness zone 10 is not limited to the position shown in such embodiment.

As described above, since the low-specific-gravity material has lower strength than the high-specific-gravity material such as titanium alloy, the thickness of the face portion 2 tends to be considerably large in order to obtain the practical durability.

However, by providing the low stiffness zone 10 in the face portion 2 side of the main body 3, when striking a ball with the club face 2*a*, this low stiffness zone 10 is locally flexed, and the rigidity of the entire head can be lessened. Therefore, the head 1 in the present embodiment can exhibit a high coefficient of restitution (high rebound performance) even if the stiffness of the face portion 2 is high.

By adjusting the stiffness of the low stiffness zone 10, the coefficient of restitution of the head 1 can be adjusted. Preferably, the coefficient of restitution of the club face 2*a* at the sweet spot SS is 0.800 or more, more preferably 0.815 or more, still more preferably 0.830 or more.

The coefficient of restitution is measured in accordance with Procedure for Measuring the velocity Ratio of a club Head for Conformance to Rule 4-1e, Revision 2 (Feb. 8, 1999) provided by united states Golf Association (U.S.G.A.).

More specifically, a golf ball shot by a ball shooting device is collided with the sweet spot of the face portion of a head set on a pedestal without being fixed thereto, and the incident velocity Vi just before the collision of the golf ball and the rebounding speed Vo are measured. Then, the coefficient of restitution e is calculated from the following equation:

$$(Vo/Vi)=(eM-m)/(M+m),$$

wherein M is the mass of the head, and m is the mass of the golf ball. The distance between the face portion and the opening of the ball shooting device from which the golf ball is launched, is 55 inches. The ball hitting position is not more than 5 mm from the sweet spot of the head, and the ball hitting direction is perpendicular to the club face. The golf ball used is that having a hardness (SCH) of 2.54+/−0.09 mm, wherein the SCH is the value of the displacement (mm) when the ball is compressed between flat plates and the load is increased from the initial load of 10 kgf to 130 kgf.

As the low stiffness zone 10, for example, a groove, a recessed portion, an opening, a slit, a thin portion and the like can be adopted as long as it has the function to locally deform the main body 3 when the club face 2*a* is hit by a ball.

Hereinafter, especially preferred examples of the low stiffness zone 10 will be described.

Figure 6:
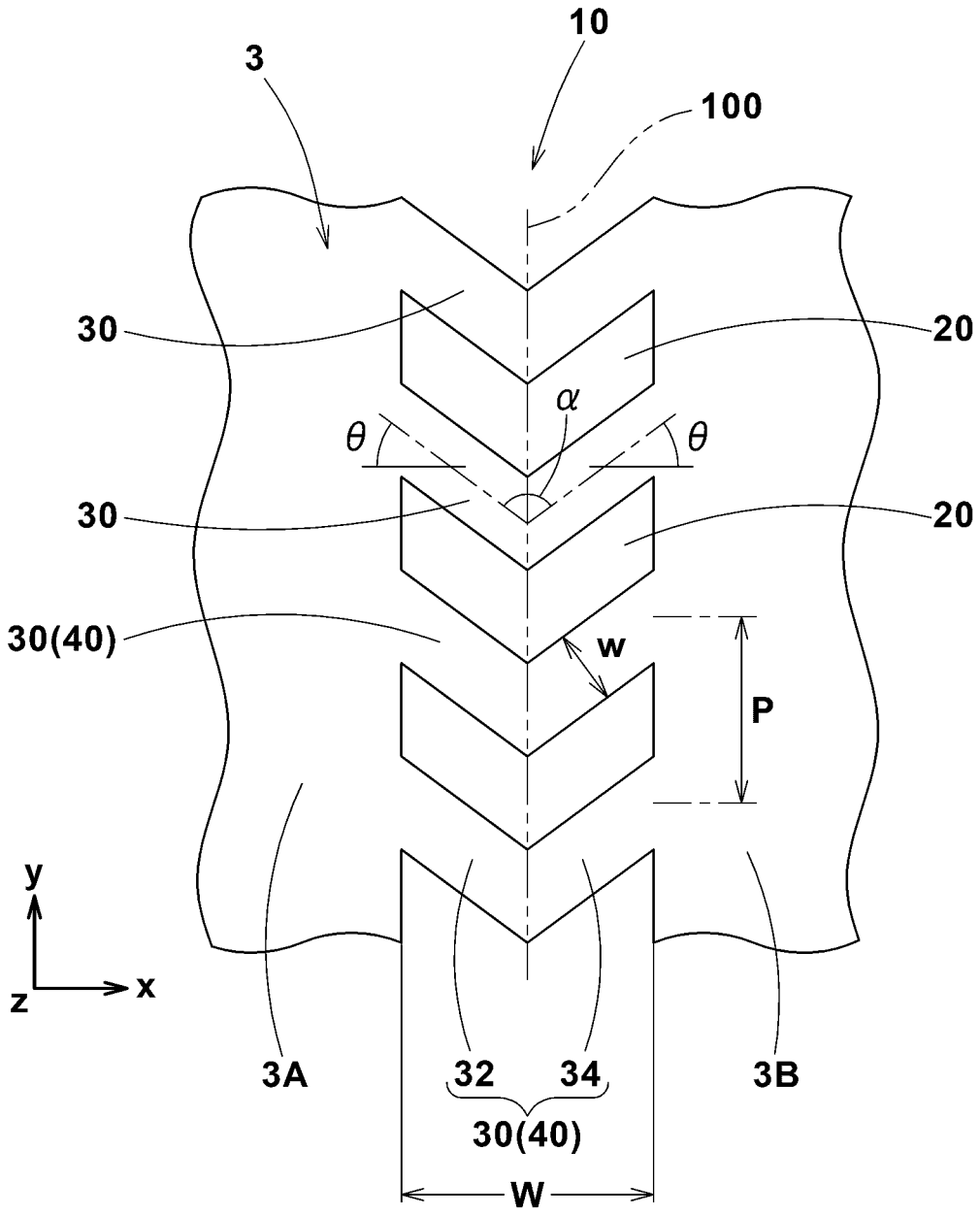
FIG. 6 is an enlarged partial plan view showing the low stiffness zone shown in FIG. 3.

FIG. 6 is an enlarged partial plan view showing the low stiffness zone 10 shown in FIG. 3.

In this example, the low stiffness zone 10 is composed of a plurality of void portions 20 and a plurality of connecting portions 30 as shown in FIG. 6. The void portions 20 and the connecting portions 30 are alternately arranged along the periphery E of the club face 2*a* as shown in FIG. 1 and FIG. 3. Accordingly, the low stiffness zone 10 in the present embodiment is formed so as to extend along the peripheral edge E of the club face 2*a*.

The peripheral edge E of the club face 2*a* is, as shown in FIG. 5, the boundary between the club face 2*a* and the main body 3.

when the peripheral edge E can be identified by a clear edge, the peripheral edge E is defined by this clear edge. However, if the peripheral edge E can not be distinguished clearly from the appearance because the club face 2*a* and the main body 3 are smoothly connected with each other, for example, via an arcuate surface, then the peripheral edge E is defined as an intermediate position of the arcuate surface for convenience sake as shown in FIG. 5.

This peripheral edge E essentially extends annularly so as to surround the club face 2*a*.

The expression "along" is intended for not only a strict meaning such that the object extends always keeping a constant distance from the peripheral edge E of the club face 2*a*, but also such a meaning that the object extends slightly inclining with respect to the peripheral edge E of the club face 2*a*. As the inclination, an angle of at least about 15 degrees is permitted in the present specification.

That is, in the low stiffness zone 10, the direction in which the void portions 20 and the connecting portions 30 are repeatedly arranged, can have an angular difference of about 15 degrees with respect to the peripheral edge E of the club face 2*a*.

Since the peripheral edge E of the club face 2*a* is usually a smooth curve in many cases, it is preferable that the low stiffness zone 10 also extends in a curved line along this, but it may also extend in a straight line.

Besides, in the present embodiment, it can be said that both the peripheral edge E and the low stiffness zone 10 of the club face 2*a* extend along the toe-heel direction y as is clear from FIG. 3.

Returning to FIG. 6, each of the void portions 20 is a through hole that penetrates the main body 3 (crown portion 4 in this example) from the outside to the inside of the head. That is, in this embodiment, the void portions 20 are formed as holes communicating the outside of the head with the hollow portion i (see FIG. 5).

The void portions 20 reduce the material constituting the main body 3 of the head 1, which helps to reduce the mass of the main body 3. Further, the void portions 20 locally reduce the rigidity of the main body 3, so it promotes the local and relatively large deformation of the main body 3 when striking a ball with the club face 2*a*.

The void portions 20 may be left as through holes. But, the void portions 20 may be filled with a material which do not substantially interfere with the deformation of the void portions 20, and have a specific gravity smaller than that of the main body, such as rubber, elastomer, resin and the like. In this case, the filled material helps to prevent foreign objects or the like from entering into the hollow portion of the head 1 through the void portions 20.

Between the adjacent void portions 20, each of the connecting portions 30 extends in the front-rear direction of the head.

The connecting portions 30 integrally connect
a front side portion 3A of the main body 3 on the club face side of the void portions 20 with
a rear side portion 3B of the main body 3 on the rear side of the void portions 20.

In the present embodiment, as a preferred embodiment, the connecting portions 30 include inclined connecting portions 40.

The inclined connecting portion 40 comprises an inclined element 32 and/or an inclined element 34, each inclined with respect to the front-rear direction x of the head when the head 1 is viewed in a normal direction to the outer surface of the head where the inclined connecting portion 40 is formed.

Upon striking a ball, the inclined connecting portions 40 receive a force directed toward the rear of the head from the front side portion 3A of the main body 3 of the head 1.

At this time, since the inclined element 32 or 34 of the inclined connecting portion 40 is inclined with respect to the front-rear direction x of the head, it easily elastically deforms (bends) in the inclined direction.

such inclined connecting portions 40 can deflect the low stiffness zone 10 more greatly when hit by a ball, and the rebound performance of the head 1 is further improved.

As described above, in the head 1 in the present embodiment has the improved low stiffness zone 10, the low stiffness zone 10 of the main body 3 can be locally largely deflected when the club face 2*a* is hit by a ball. Therefore, the head 1 in the present embodiment can exhibit a high coefficient of restitution (high rebound performance) even if the stiffness of the face portion 2 is high.

If each of the connecting portions 30 extends parallel to the front-rear direction x of the head, buckling may occur in the connecting portion during striking the ball.

For example, when the connecting portions extending parallel to the front-rear direction x of the head, are subjected to a force in the front-rear direction of the head, the connecting portions exhibit high rigidity at an initial stage in terms of time. However, if once the force exceeds a buckling load, the connecting portions are greatly deformed, and may exhibit an unstable deformation behavior.

Although not particularly limited, it is preferred that the low stiffness zone 10 has a width w of about 5 to 20 mm in the front-rear direction of the head, for example.

[Angle of Inclined Element]

Preferably, the inclined connecting portion 40 comprises the first inclined element 32 inclined in a first direction with respect to the front-rear direction x of the head, and the second inclined element 34 inclined in a second direction opposite to the first direction of the first inclined element 32. The inclined connecting portion 40 may include only one of the first inclined element 32 and the second inclined element 34. In the example shown in FIG. 6, the inclined connecting portion 40 integrally includes the first inclined element 32 and the second inclined element 34 and is bent in a v shape.

Further, the low stiffness zone 10 of the present embodiment is configured to include a portion in which a plurality of the inclined connecting portions 40 are arranged adjacently. Accordingly, the void portions 20 also include those having a V-shaped contour shape.

In the case of the inclined connecting portion 40 having the first inclined element 32 and the second inclined element 34 which are inclined in opposite directions to each other, when striking a ball, the two inclined elements 32 and 34 are elastically deformed in a preferred manner such that the angle ix between them is reduced, and the inclined connecting portions 40 become easier to be bent.

In order to more effectively obtain such effect, the inclination angles θ of the first inclined element 32 and the second inclined element 34 with respect to the front-back direction x of the head are preferably set in a range from 20 to 70 degrees, more preferably from 30 to 60 degrees.

Preferably, the inclined connecting portion 40 have a symmetrical shape with respect to a line 100 in the longitudinal direction of the low stiffness zone 10.

Such low stiffness zone 10 helps to prevent the rear side portion 3B of the main body 3 from being moved relatively to the front side portion 3A of the main body 3 in the direction of the line 100 in the longitudinal direction of the low stiffness zone 10 when the low stiffness zone 10 is elastically deformed by striking a ball. That is, the low stiffness zone 10 deflects in the front-rear direction x of the head.

On the other hand, in order to promote the deformation of each of the connecting portions 30 at the time of striking a ball, it is desirable that the inclined connecting portions 40 have an asymmetric (non-line symmetrical) shape with respect to the front-rear direction x of the head.

[Width and Arrangement Interval of Connecting Portions]

As shown in FIG. 6, the width w, the arrangement interval (pitch) P and the like of the connecting portions 30, in the plan view of the connecting portions 30, can be determined variously according to the material constituting the main body 3, an increase level of the rebound performance to be achieved and the like.

Although not particularly limited, the width w may be about 0.5 to 3 mm, and the pitch P may be about 2 to 10 mm for example. Further, the width w, the pitch P and the like may be constant for all the connecting portions 30 or may be varied.

when the connecting portions 30 are arranged essentially at a constant pitch P, the low stiffness zone 10 can be deflected uniformly in substance.

Here, the width w is measured in a direction orthogonal to the longitudinal direction of the inclined element.

[Position of Low Stiffness Zone]

Preferably, the low stiffness zone 10 is disposed at a position close to the face portion 2 as shown in FIG. 5, so as to be greatly deflected at the time of striking a ball.

In the present embodiment, the low stiffness zone 10 is disposed at a position apart from the back face 2*b* of the face portion 2 toward the rear of the head by a distance L (not 0). The distance L is a distance in the front-rear direction of the head from the back face 2*b* of the face portion 2 to the void portions 20.

By providing the low stiffness zone 10 in an area close to the face portion 2, the rebound performance of the head 1 can be improved.

It is particularly desirable that the primary natural frequency of the head 1 under such a condition that a partial region (of a 10 mm diameter circle) of the club face 2*a* is fixed, which frequency greatly affects the ball rebound performance (coefficient of restitution), is set to be close to the primary natural frequency of the ball under such a condition that a point on the ball is fixed. More specifically, the primary natural frequency of the head measured under such a condition that only the sweet spot SS of the club face 2*a* is fixed, is preferably set to be 700 Hz or more, more preferably 1000 Hz or more. And the primary natural frequency is preferably set to be 1600 Hz or less, more preferably 1400 Hz or less.

In the vibration mode at the primary natural frequency of a general golf club head under the condition where the club face is fixed, mainly the club face is subject to deformation, and the main body mainly acts as a mass.

By reducing the rigidity of the area of the main body 3 near the club face 2*a* in order that the area is deformed at the time of striking a ball, a part on the rear side of the area will act as a mass. Since the natural frequency decreases as the mass increases, it is preferable that the low stiffness zone 10 is formed closely to the face portion 2.

From such viewpoint, it is desirable that the above-mentioned distance L is set to be 50% or less, preferably 30% or less, more preferably 20% or less of the maximum length (A) of the head 1 in the front-rear direction of the head as shown in FIG. 5.

Figure 7:
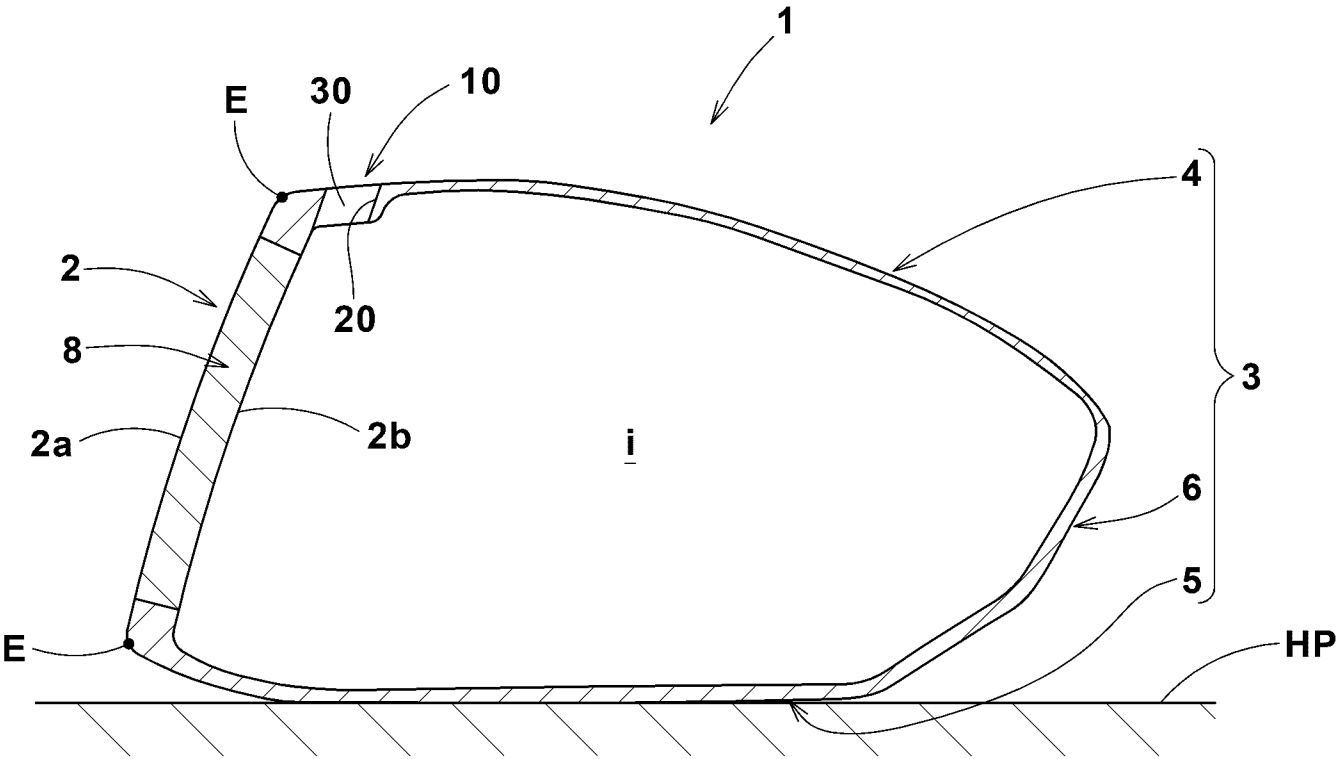
FIG. 7 is an enlarged cross-sectional view taken along line A-A in FIG. 3 showing a modified example of the low stiffness zone.

FIG. 7 is a cross-sectional view showing a modified example of the low stiffness zone, wherein the low stiffness zone 10 is formed immediately behind the back face 2*b* of the face portion 2. Thus, the above-mentioned distance L is substantially zero. In this case, even if the low stiffness zone 10 is relatively small, the rebound performance can be effectively enhanced.

[Thickness of Connecting Portion]

Figure 8:
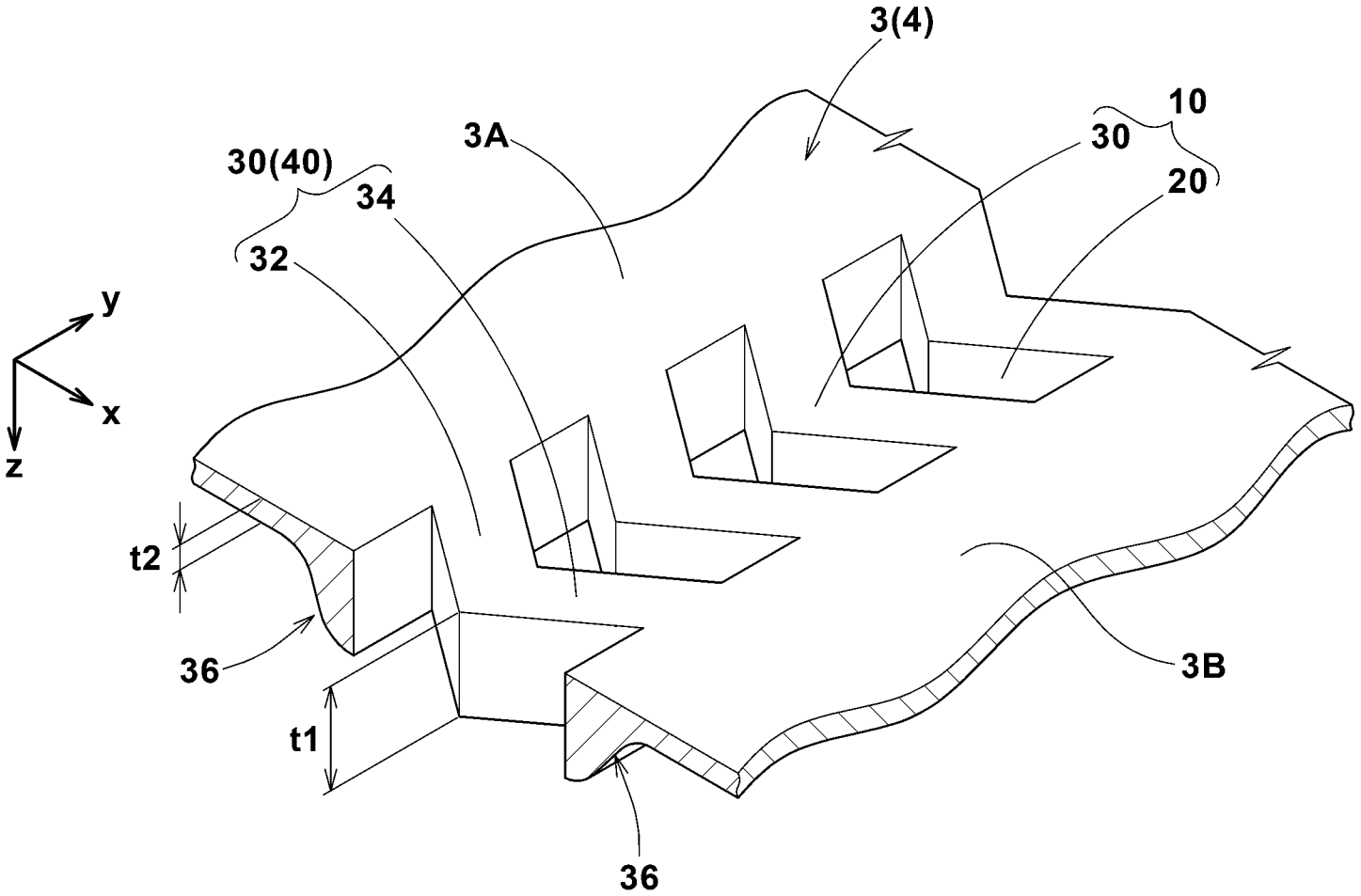
FIG. 8 is an enlarged perspective partial view showing a modified example of the low stiffness zone.

FIG. 8 is an enlarged perspective partial view of the low stiffness zone 10.

It is desirable that, as shown in FIG. 8, the thickness t1 of the connecting portion 30 (the thickness in the cross section of the main body 3) is set to be larger than the thickness t2 (minimum thickness) of the portion other than the connecting portion 30 of the main body 3.

Such low stiffness zone 10 can enhance the out-of-plane shear rigidity of the low stiffness zone 10, while keeping a low compressive rigidity in the front-rear direction x in the plane of the member provided with the low stiffness zone 10 (in this example, a low compressive rigidity in the plane of the crown portion 4) which is important for improving rebound performance. Consequently, it is possible to further enhance the durability of the head 1.

It is preferable that the connecting portion 30 having the thickness t1 and the portion having the less thickness t2 are connected via a thickness transition portion 36 whose thickness varies smoothly between them in order to prevent stress concentration.

[Chamfering of Connecting Portion]

Figure 9:
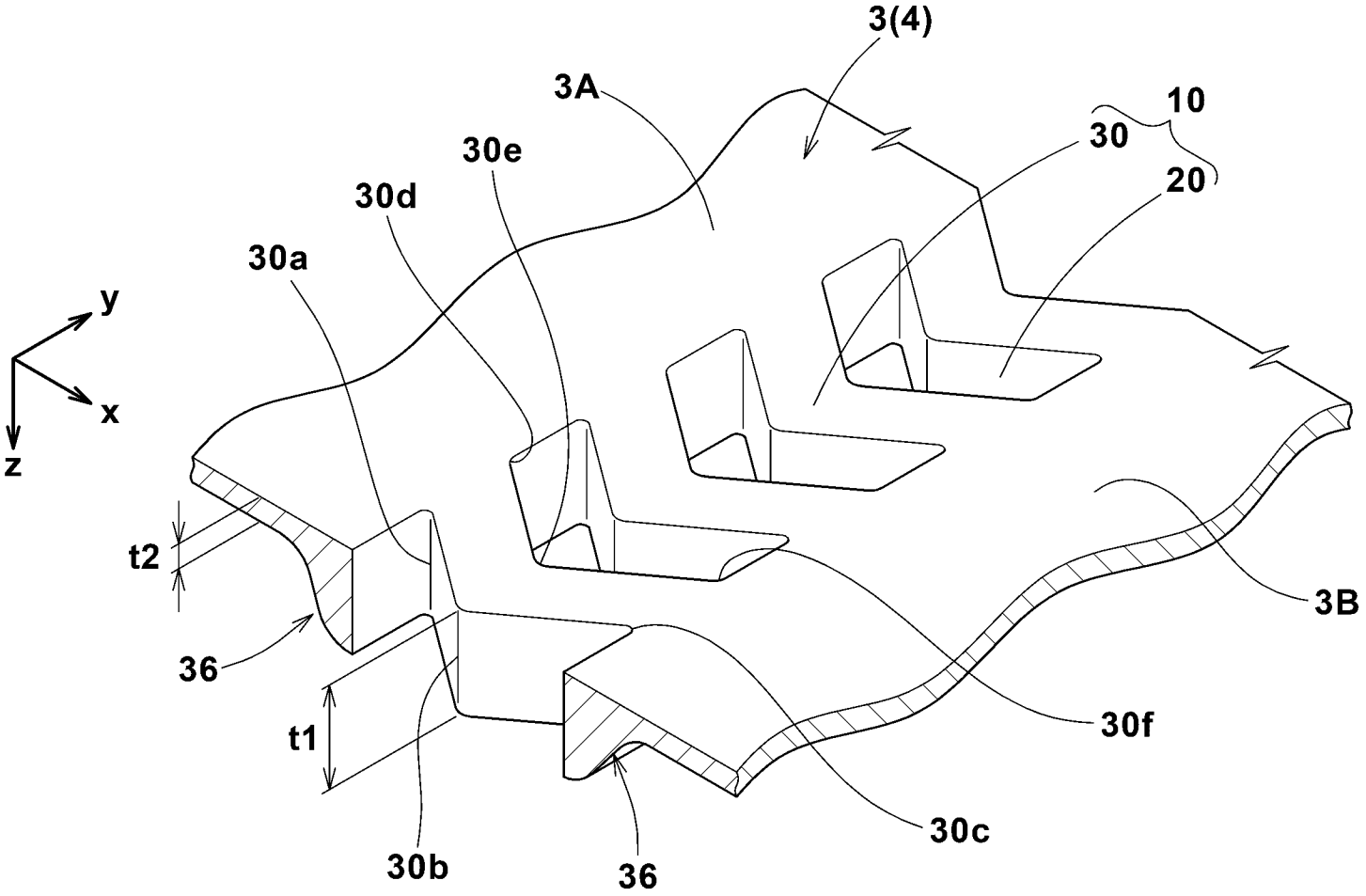
FIG. 9 is an enlarged perspective partial view showing a modified example of the low stiffness zone.

FIG. 9 is an enlarged perspective partial view showing a modified example of the low stiffness zone 10, wherein each of corner portions 30*a* to 30*f* of the connecting portion 30 is rounded with a smooth arcuate surface. In this case, it is possible to effectively prevent stress concentration at the corner portions 30*a* to 30*f* at the time of striking a ball.

Modified Example 1 of Inclined Connecting Portion

Figure 10:
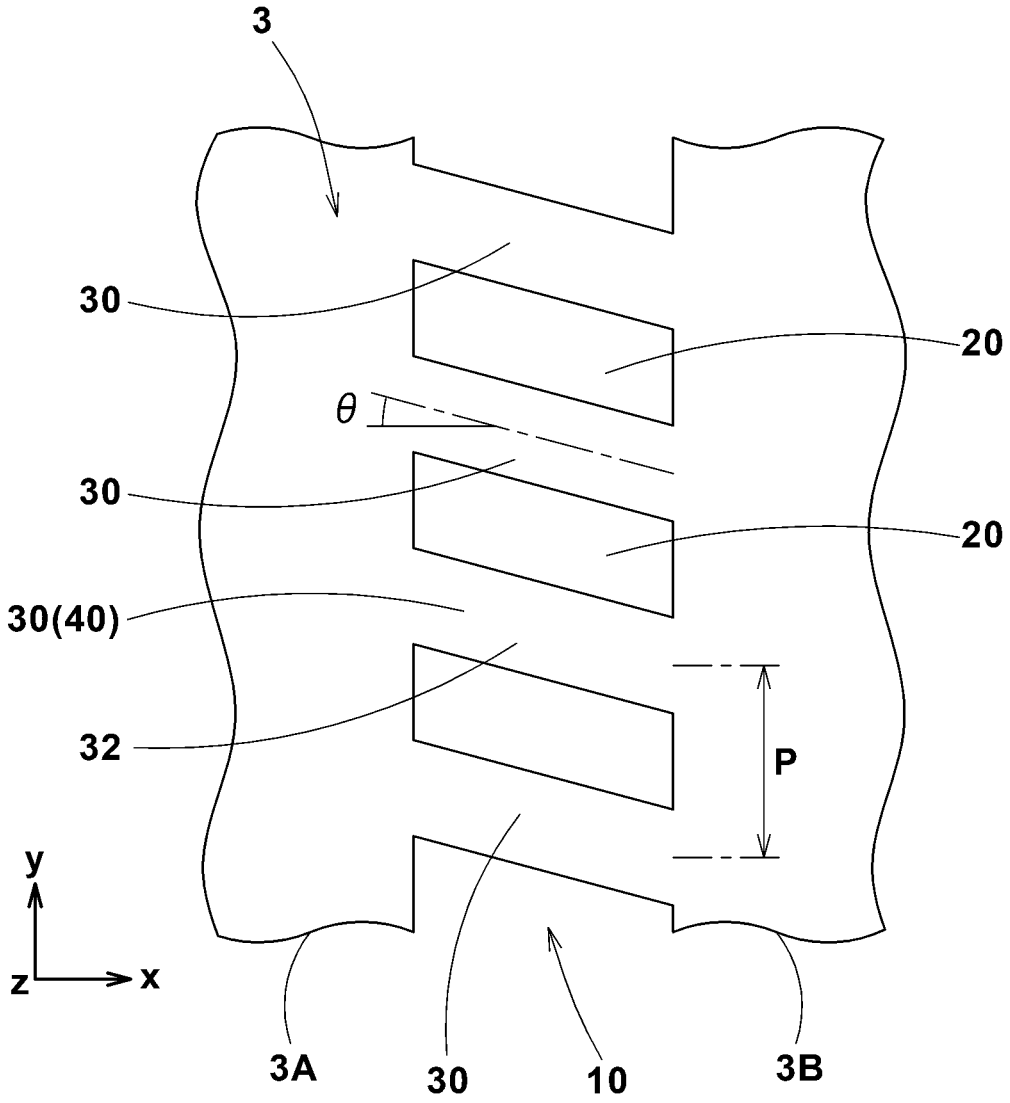
FIG. 10 is an enlarged partial plan view showing a modified example of the low stiffness zone.

FIG. 10 is an enlarged partial plan view of another example of the low stiffness zone 10 showing a modified example 1 of the inclined connecting portion 40, wherein the inclined connecting portion 40 consists of only one of the first inclined element 32 and the second inclined element 34. In this case, it is desirable that the first inclined element 32 or the second inclined element 34 is inclined with respect to the front-rear direction x of the head at the above-mentioned inclination angle θ.

Modified Example 2 of Low Stiffness Zone

Figure 11:
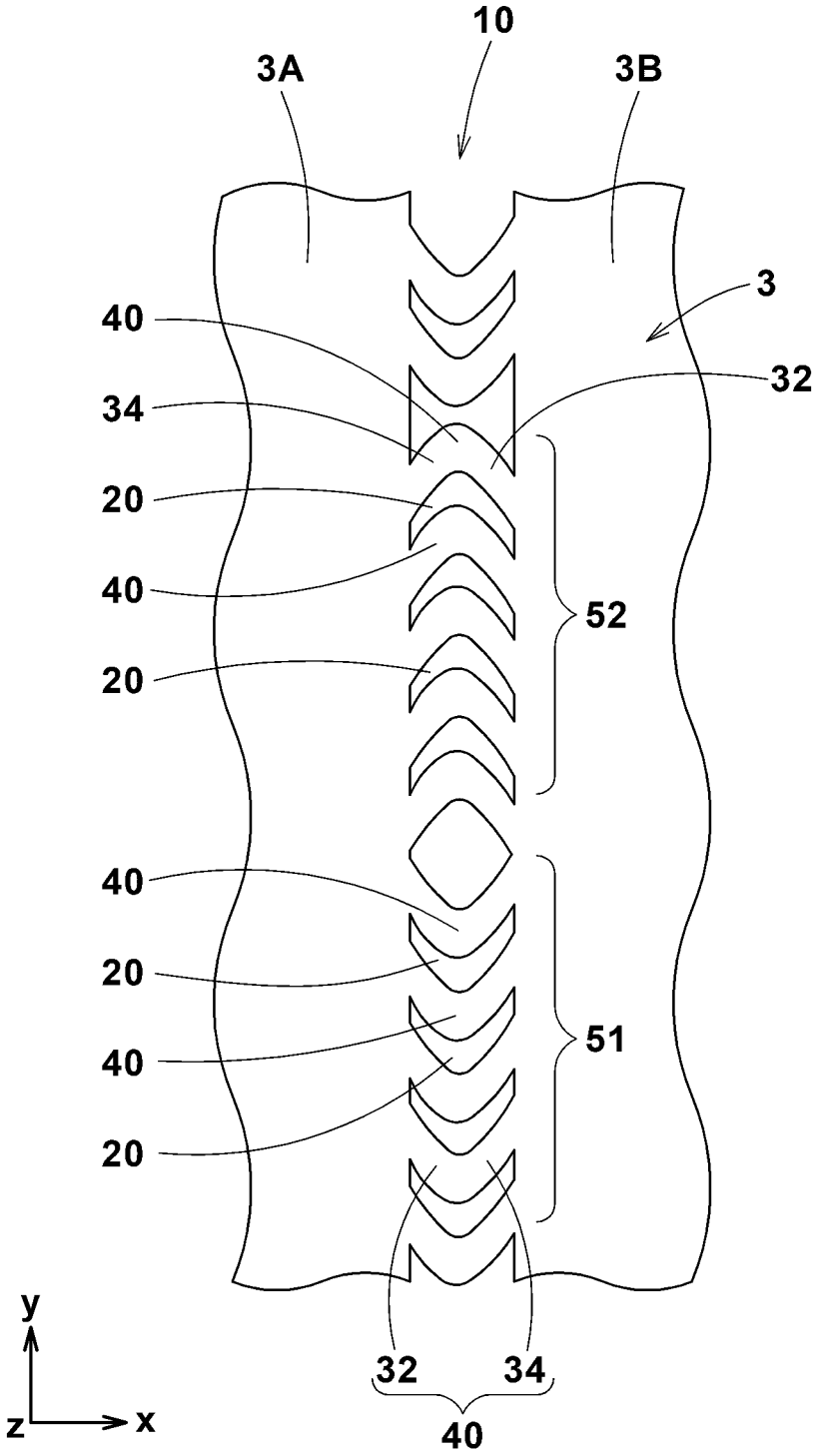
FIG. 11 is an enlarged partial plan view showing a modified example of the low stiffness zone.

FIG. 11 is an enlarged partial plan view showing a modified example 2 of the low stiffness zone 10, wherein the low stiffness zone 10 comprises a first portion 51 and a second portion 52 which are arranged along the peripheral edge E of the club face 2*a* (shown in FIG. 1 and others).

The first portion 51 includes a plurality of the inclined connecting portions 40 each having a v-shape which is downwardly convex in FIG. 11. That is, in each of the inclined connecting portions 40 belonging to the first portion 51, the first inclined element 32 is disposed adjacently to the front side portion 3A of the main body 3, and the second inclined element 34 is disposed adjacently to the rear side portion 3B of the main body 3. Then, a plurality of them are arranged adjacent to each other.

The second portion 52 includes a plurality of the inclined connecting portions 40 each having a V-shape which is upwardly convex in FIG. 11, namely, an inverted v-shape. That is, in each of the inclined connecting portions 40 belonging to the second portion 52, the first inclined element 32 is disposed adjacently to the rear side portion 3B of the main body 3, and the second inclined element 34 is disposed adjacently to the front side portion 3A of the main body 3. Then, a plurality of them are arranged adjacent to each other.

According to such arrangement, the low stiffness zone 10 serves to offset the components of the force in the toe-heel direction generated in the connecting portion 30 when deformed by striking a ball.

[Position of Low Stiffness Zone]

Figure 12:
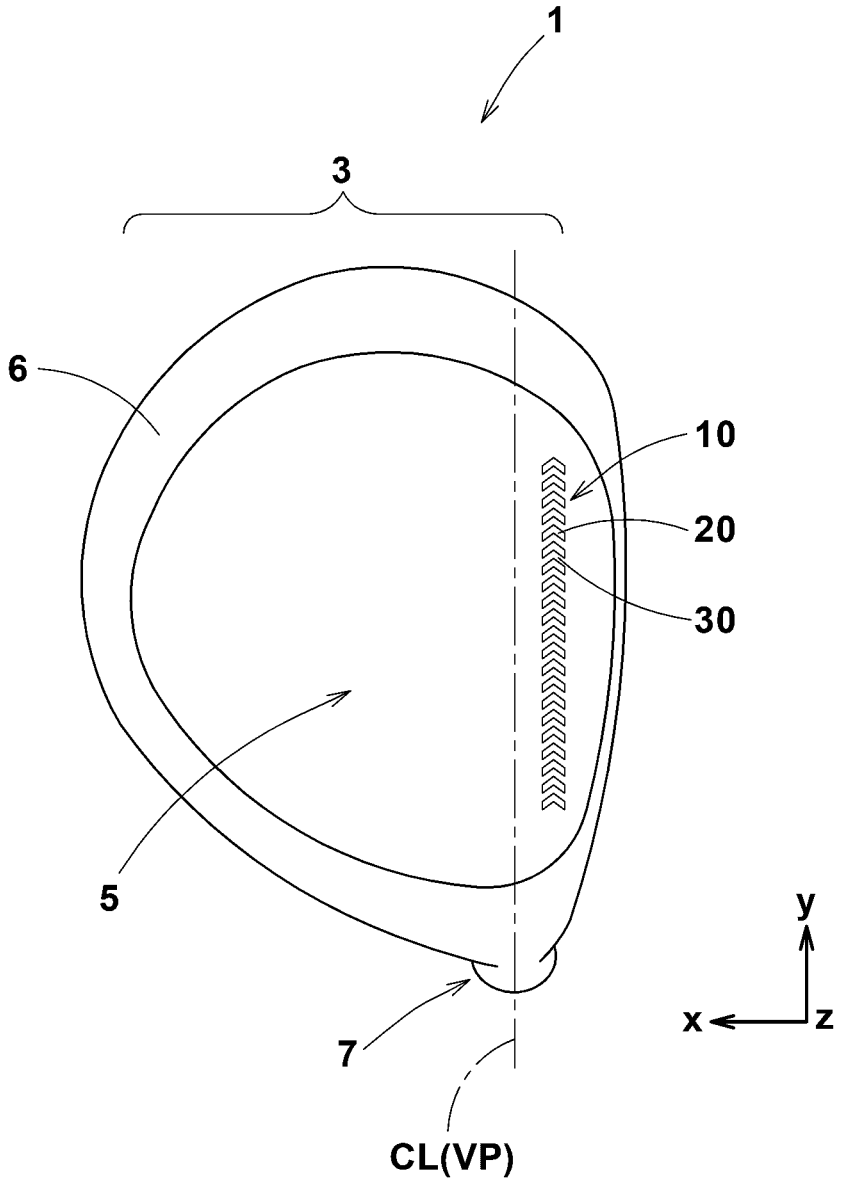
FIG. 12 is a bottom view of a golf club head as another embodiment of the present invention.

FIG. 12 is a bottom view of a golf club head as another embodiment of the present, wherein the low stiffness zone 10 is formed in the sole portion 5.

Figure 13:
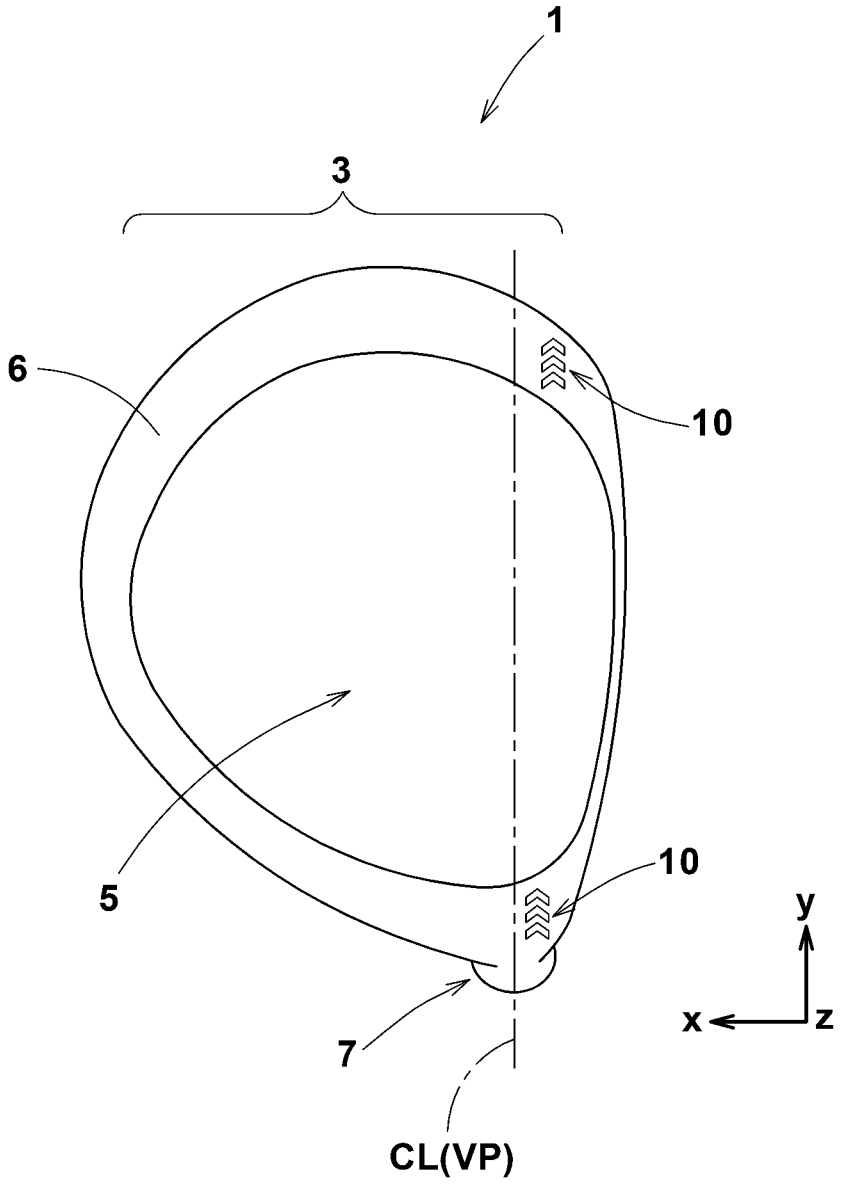
FIG. 13 is a bottom view of a golf club head as still another embodiment of the present invention.

FIG. 13 is a bottom view of a golf club head as still another embodiment of the present invention, wherein the low stiffness zone 10 is formed in a toe side and a heel side of the side portion 6.

In the case where the low stiffness zone 10 is formed in the side portion 6, the low stiffness zone 10 may be provided only in a toe side of the side portion 6 or only in a heel side of the side portion 6.

Figure 14:
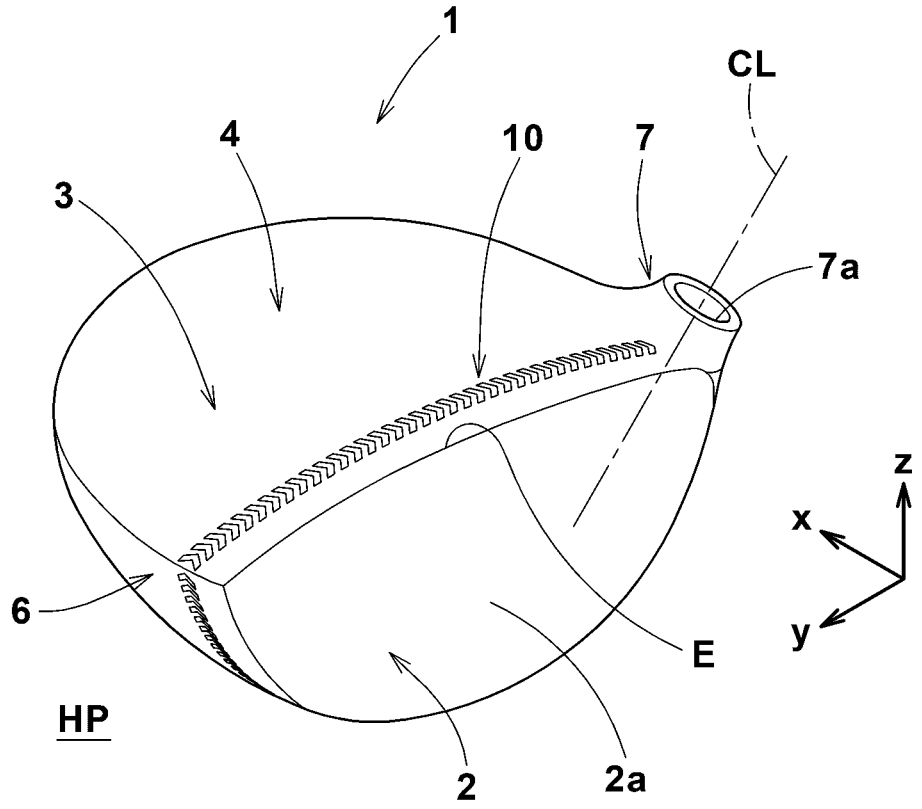
FIG. 14 is a perspective view of a golf club head as yet still another embodiment of the present invention.

FIG. 14 is a perspective view of a golf club head as yet still another embodiment of the present invention, wherein the low stiffness zone 10 is formed so as to extend over at least two of the crown portion 4, the side portion 6 and the sole portion 5. As a result, the rigidity of the main body 3 can be reduced over a wider range, and the rebound performance can be further enhanced.

While detailed description has been made of preferable embodiments of the present invention, the present invention can be embodied in various forms without being limited to the illustrated embodiments. Especially, in this application, it should be noted that a constituent element of an example or its modified example of the head may be applied to other examples of the head even if not explicitly mentioned.

EXAMPLE

Hereinafter, a more specific example of the head according to the present invention will be described, but the present invention is not limited to such example.

Based on the head structure shown in FIGS. 1 to 4, wood-type hollow golf club heads (practical example EX, comparative example REF1 and comparative example REF2) were designed according to specifications shown in Table 1. Their main bodies had the substantially same design except for the presence or absence of the low stiffness zone. Then, the right-and-left moment of inertia, up-and-down moment of inertia, and primary natural frequency of each head were obtained by FEM simulation using a computer.

In the practical example of the head, the face plate was made of a carbon fiber reinforced plastic (cFRP), and had a constant thickness of 5 mm. And the low stiffness zone had the configuration shown in FIGS. 5, 6 and 8, and extended from the crown portion to the sole portion through a toe side of the side portion as shown in FIG. 14.

In the comparative example 1 of the head, its entirety is made of a titanium alloy as a high-specific-gravity material, and the face plate had a variable thickness such that a thick part formed in the center of the club face had a maximum thickness of 3.6 mm, a thin part formed in a peripheral region of the club face had a minimum thickness of 1.9 mm, and a transition part formed therebetween had a thickness smoothly changed between the maximum thickness and minimum thickness.

In the comparative example 2 of the head, the main body was made of a titanium alloy as a high-specific-gravity material, and the face plate was made of a carbon fiber reinforced plastic (cFRP), and had a constant thickness of 5.0 mm.

The primary natural frequency of each head is the natural frequency obtained under such boundary condition that the hitting point of the club face of the FEM model of the head is fixed.

In the FEM simulation, the fixation was made by constraining displacement of all nodes of the FEM model existing within a circle of 5 mm radius around a position of the club face corresponding to the sweet spot.

The vibration mode under the above-mentioned boundary condition includes, in low order modes at low vibration frequencies, a mode in which the entire head falls without moving the fixed point and a mode in which the head rotates such that the club face is twisted without moving the fixed point. These two modes are not modes excited by collision with the ball, therefore, they do not affect the coefficient of restitution of the head.

In the FEM simulation, a vibration mode, in which the head as a whole was displaced in the collision direction of the ball without moving the fixed point of the club face, and of which vibration frequency was lowest, was obtained as the natural frequency because such vibration mode most affects the coefficient of restitution.

The simulation results are shown in Table 1.

TABLE 1

| Head | EX | REF1 | REF2 |
|---|---|---|---|
| Head main body | | | |
| material | 6-4 Titanium | 6-4 Titanium | 6-4 Titanium |
| specific gravity | 4.4 | 4.4 | 4.4 |
| elastic modulus (GPa) | 106 | 106 | 106 |
| Face plate | | | |
| materials | CFRP | 6-4 Titanium | CFRP |
| specific gravity | 1.5 | 4.4 | 1.5 |
| elastic modulus (GPa) | 50 | 106 | 50 |
| thickness (mm) | 5.0 | Max: 3.6, Min: 1.9 | 5.0 |

TABLE 1-continued

| Head | EX | REF1 | REF2 |
|---|---|---|---|
| Low stiffness zone | | absent | absent |
| position | crown, side and sole portions (continuous) | | |
| structure | FIGS. 6 and 8 | | |
| L (mm) | 0 | | |
| t1 (mm) | 3 | | |
| w (mm) | 0.83 | | |
| θ (deg.) | 30 | | |
| P (mm) | 5 | | |
| W (mm) | 9 | | |
| mass of head (g) | 184 | 180 | 163 |
| mass of face portion (g) | 28 | 45 | 28 |
| right-and-left moment of inertia (gram sq.cm) | 4367 | 4170 | 3756 |
| up-and-down moment of inertia (gram sq.cm) | 2626 | 2590 | 2272 |
| primarily natural frequency (Hz) | 1258 | 1298 | 1647 |

Through the simulation, it can be confirmed that, although the mass of the practical example was comparable to that of the comparative example 1, the right-and-left moment of inertia of the practical example is larger than the comparative example 1. In addition, although the thickness of the face portion of the practical example was as large as 5 mm, the primarily natural frequency of the practical example became 1258 Hz by being provided with the low stiffness zone. Since 1258 Hz is nearly equal to 1300 Hz which is considered as being good for rebound, it is presumed that a preferable rebound performance can be obtained.

DESCRIPTION OF THE REFERENCE SIGNS

1 golf club head
2 face portion
2*a* club face
3 main body
4 crown portion
5 sole portion
6 side portion
8 face plate
10 low stiffness zone
20 void portions
30 connecting portions
32 first inclined element
34 second inclined element
40 inclined connecting portions
E peripheral edge of club face

The invention claimed is:

1. A hollow golf club head comprising:

a face portion having a club face for striking a ball, and a main body extending rearward of the head from the face portion, wherein the face portion is made of a low-specific-gravity material having a specific gravity of 4.0 or less, and the main body is provided in its face portion side with a low stiffness zone where the stiffness is locally reduced, wherein the low stiffness zone comprises void portions penetrating the main body from the inside to the outside of the head, and connecting portions each extending in a front-rear direction of the head, the void portions and the connecting portions are alternately arranged along a peripheral edge of the club face, each of said connecting portions is bent in a V-shape and composed of a first inclined element inclined with respect to the front-rear direction of the head to a first direction, and a second inclined element inclined with respect to the front-rear direction to a second direction opposite to the first direction, and the void portions between said connecting portions each have a V-shaped contour shape.

2. The golf club head according to claim 1, wherein the low stiffness zone is disposed in one of a crown portion, a side portion and a sole portion of the main body.

3. The golf club head according to claim 1, wherein the face portion is made of one of an aluminum alloy, a magnesium alloy, an aluminum lithium alloy, a magnesium lithium alloy and a fiber-reinforced plastic.

4. The golf club head according to claim 1, wherein the face portion made of the low-specific-gravity material has a minimum thickness of 3.0 mm or more.

5. The golf club head according to claim 1, wherein the club face has a coefficient of restitution of 0.800 or more at a sweet spot of the club face.

6. The golf club head according to claim 1, wherein the head has a primary natural frequency of from 700 to 1500 Hz when measured under a condition where only a sweet spot of the club face is fixed.

7. The golf club head according to claim 1, wherein a moment of inertia of the head around a vertical axis passing through the center of gravity of the head is 4000 to 6000 gram sq·cm.

8. The golf club head according to claim 1, wherein a moment of inertia of the head around a horizontal axis extending in a toe-heel direction of the head passing through the center of gravity of the head is 2000 to 4000 gram sq·cm.

9. The golf club head according to claim 1, wherein a center-of-gravity distance of the head is 17 to 35 mm, wherein the center-of-gravity distance is a distance in the front-rear direction of the head between the center of gravity of the head and a vertical plane (VP) including a club shaft center line (CL).

10. The golf club head according to claim 1, wherein the mass of the face portion is 15 to 45 grams.

11. The golf club head according to claim 1, wherein the low-specific-gravity material has a specific gravity of 3.0 or less.

12. The golf club head according to claim 1, wherein the main body is made of a high-specific-gravity material having a specific gravity of greater than 4.0.

13. The golf club head according to claim 1, wherein the low stiffness zone is disposed in two of a crown portion, a side portion and a sole portion of the main body.

14. The golf club head according to claim 1, wherein the low stiffness zone is disposed in all of a crown portion, a side portion and a sole portion of the main body.

15. The golf club head according to claim 1, wherein the face portion is made of a fiber-reinforced plastic, and the face portion has a minimum thickness of 3.0 mm or more.

16. The golf club head according to claim 15, wherein the main body is made of a metal material having a specific gravity greater than that of the face portion.

17. The golf club head according to claim 15, wherein the main body is made of a titanium alloy.

18. The golf club head according to claim 1, wherein said connecting portions are symmetrical about a line extending along a longitudinal direction of the low stiffness zone.

19. The golf club head according to claim 18, wherein said first inclined element and said second inclined element are inclined at an angle in a range from 30 to 60 degrees with respect to the front-back direction of the head.

20. The golf club head according to claim 19, wherein the low stiffness zone has a width W in a range from 5 to 20 mm in the front-rear direction of the head, said connecting portions each have a width (w) in a range from 0.5 to 3 mm, and said connecting portions are arranged at a pitch (P) in a range from 2 to 10 mm.

* * * * *